United States Patent [19]

Young

[11] 4,185,336

[45] Jan. 29, 1980

[54] ELECTRICALLY CONTROLLED DRAIN AND VENT SYSTEM FOR SINKS AND THE LIKE

[76] Inventor: Lyle M. Young, 1807 W. Minnehaha, St. Paul, Minn. 55104

[21] Appl. No.: 941,280

[22] Filed: Sep. 11, 1978

[51] Int. Cl.[2] ..... A47K 1/14; E03C 1/26; E03C 1/242

[52] U.S. Cl. ..... 4/286; 4/287; 251/129; 200/84 C; 4/406

[58] Field of Search ..... 4/286, 295, 191, 192, 4/249, 405, 406, DIG. 3; 251/129, 130, 132; 137/412, 409; 200/84 R, 84 C

[56] References Cited

U.S. PATENT DOCUMENTS

| | | | |
|---|---|---|---|
| 3,429,552 | 2/1969 | Huley et al. | 251/129 |
| 3,580,238 | 5/1971 | Diehl | 251/129 X |
| 3,812,398 | 5/1974 | Kozel et al. | 251/129 |
| 3,955,795 | 5/1976 | Neely | 251/129 |
| 4,008,876 | 2/1977 | Bastle | 251/129 |
| 4,064,755 | 12/1977 | Bongort et al. | 200/84 C X |
| 4,085,921 | 4/1978 | Ueda et al. | 251/129 |

*Primary Examiner*—Henry K. Artis

*Attorney, Agent, or Firm*—Peterson, Palmatier, Sturm & Sjoquist, Ltd.

[57] ABSTRACT

A deenergized solenoid operated valve normally closes the drain line of a sink, basin, tub or toilet bowl, the valve thus serving as a stopper. When a pushbutton switch is closed, the solenoid is energized to retract the valve and open the drain, a flow responsive switch maintaining the solenoid energized until all of the water has drained from the sink or bowl. A float responsive switch will also energize the solenoid to retract the valve and open the drain if water accumulates from a leaky faucet. Whenever water is drained, the low pressure or vacuum that results produces an accompanying venting action. The invention may be used with a P or S-type drain connection and/or with a conventional stack vent, but does not require that any of these be employed.

17 Claims, 6 Drawing Figures

ELECTRICALLY CONTROLLED DRAIN AND VENT SYSTEM FOR SINKS AND THE LIKE

BACKGROUND OF THE INVENTION

1. Field of the Invention

This invention relates generally to drains and vents for sinks, basins, tubs, and toilets, and pertains more particularly to an electrically controlled system for normally closing the drain, yet permitting the drain to be opened when the user wishes to empty the sink or automatically when water has accumulated from a leaky faucet.

2. Description of the Prior Art

U-shaped traps have been utilized in connection with household sinks, tubs and basins to seal such fixtures from the sewer, the water in the trap, as long as it remains there, preventing sewer gases from passing through the trap into the building. Generally speaking, such simplified arrangements have functioned satisfactorily, although at times siphoning takes place which will draw all of the water from the trap, thereby rendering the trap ineffectual for its intended purpose. The trapped water prevents any discharge of objectionable odors from the room via the drain line, for the trapped water serves as a blocking medium. Of course, if the water were removed, then the odors could escape, but then the trap, as explained above, would not function to prevent a reverse flow of sewer gases. Still further, the prior art systems with which I am acquainted require the use of manually manipulated stoppers for holding water in the sink, basin or tub.

SUMMARY OF THE INVENTION

Accordingly, one important object of my invention is to provide an electrically controlled drain system which is quite versatile and which performs a number of useful purposes.

Another object of the invention is to provide an electrically controlled drain system for sinks and the like which can be readily installed.

Another object of my invention is to eliminate the need for either a P or S drain connection, as well as the U-shaped trap normally associated therewith. However, my invention can be employed in association with these items.

The invention also has for an object the elimination of the customary stack or roof vent, although my invention can readily be used therewith.

A further object is to permit the use of flexible hose in the drain line, thereby readily accommodating for any offsetting or misalignment that may exist between the tailpiece and the line continuing to the sewer.

Yet another object is to prevent the flow of sewer gases upwardly through a drain line without relying upon the usual trap, thereby obviating any chance of the trap water being siphoned out as occasionally happens with the usual type of drain system. Stated somewhat differently, my invention provides a positive assurance that sewer gases will not enter a building.

A further object of the invention is to obviate the need for a drain stopper in the sink, basin or tub.

Still further, an object is to automatically remove any dripping water that might collect in a drain system of the envisaged character.

A very general object of the invention is to fulfill all of the requirements dictated by plumbing codes, and yet provide additional advantages that will make my electrically controlled drain system exceedingly appealing and thus encourage its widespread adoption.

DESCRIPTION OF THE PREFERRED EMBODIMENT

Figure 1:
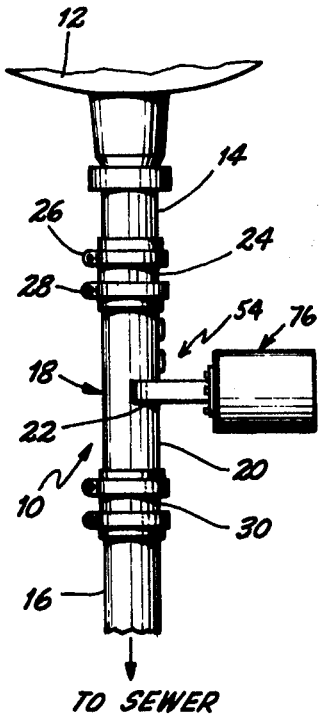
FIG. 1 is a front elevational view of my drain system when connected to a fragmentarily depicted sink.

My electrically operated drain system has been denoted generally by the reference numeral 10. From FIG. 1 it will be discerned that the system 10 is depicted in association with a fragmentarily pictured sink 12. It will be understood that the sink 12 can be a tub, basin or toilet which requires a drain connection. Extending downwardly from the sink 12 is a tailpiece 14. Also, it can be observed from FIG. 1 that a portion of a drain line 16 has been presented, the drain line leading to the sewer not shown.

As far as the control apparatus employed when practicing my invention, it has been designated by the reference numeral 18. While the invention is adaptable to other types of piping, it will be assumed for the sake of facile discussion that a section of plastic tube 20, such as nylon, acrylic, polyethylene or vinyl, has been utilized. The plastic tube 20 is modified by a cutout at 22, the configuration of which will be better appreciated as the description progresses.

As can also be noted from FIG. 1, there is an upper rubber sleeve 24 that encircles the lower end of the tailpiece 14. It simplifies the description somewhat to show only the rubber sleeve 24 along with a pair of upper hose clamps 26 and 28. It will be appreciated, however, that various types of threaded arrangements using slip nuts can be employed instead of the rubber sleeve 24 and the hose clamps 26, 28. Similarly, a lower rubber sleeve 30 encircles the bottom end of the plastic tube 20 and the upper end of the drain line 16. Here again, a pair of hose clamps 32 and 34 have been pictured which simply hold the sleeve 30 in place with respect to the upper end of the drain line 16 and the lower end of the plastic tube 20. The use of flexible sleeves 24 and 30 of appropriate length will enable a considerable degree of misalignment or offsetting between the tailpiece 14 and line 16 to be accommodated.

Figure 5:
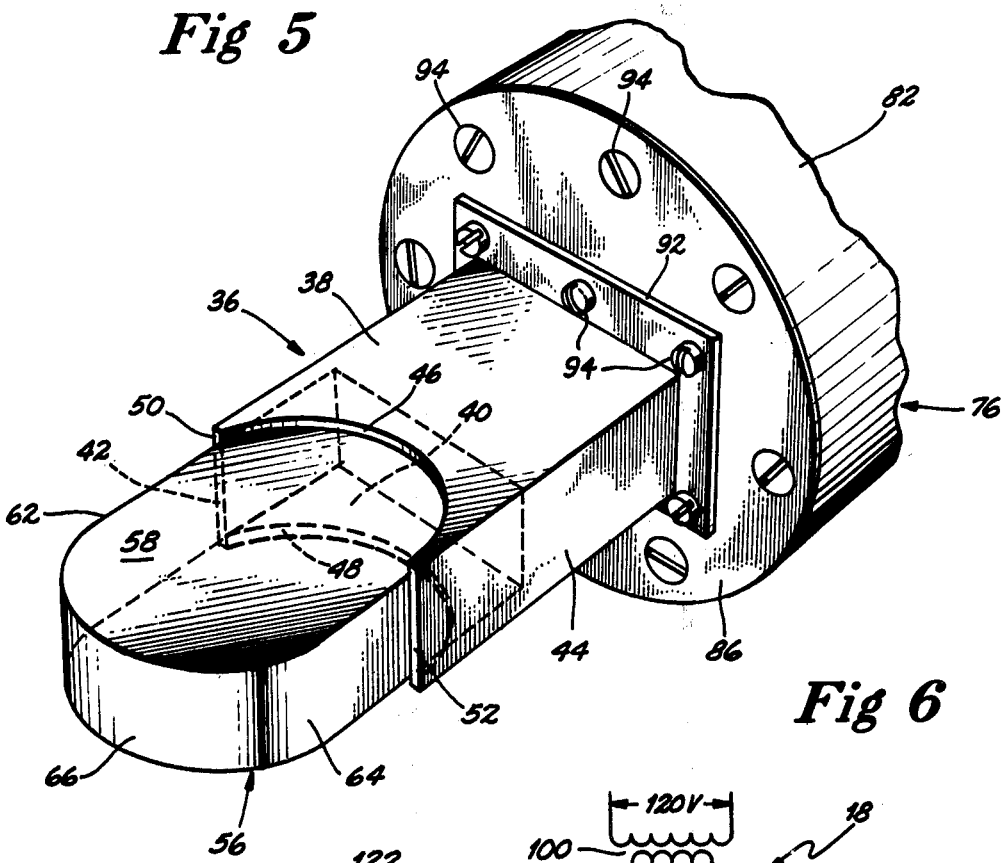
FIG. 5 is a perspective view of the solenoid valve assembly sectionally portrayed in FIGS. 2 and 4.

Describing now the control apparatus 18, it can be best understood from FIG. 5 that a valve casing 36, which is preferably of the same plastic material as the tube 20, is employed. The valve casing 36 has a top wall or panel 38, a bottom wall or panel 40 and side walls 42, 44. The top wall 38 has a curved edge at 46, whereas the bottom wall 40 has a curved edge at 48. The forward ends of the side walls 42 and 44 have vertical edges 50 and 52, respectively. In this way, the various edges 46, 48, 50 and 52 fit snugly against the edges of the cutout 22. Inasmuch as the edges 46–52 fit the edges of the cutout 22, a suitable adhesive can be employed for fixedly securing the valve casing 36 to the tube 20, the adhesive being applied to the edges of the cutout 22 and the edges 46–52.

At this time, attention is directed to a solenoid valve assembly indicated generally by the reference numeral 54. More specifically, the solenoid valve assembly 54 includes a soft elastomeric valve member 56 having a flat top 58, a flat bottom 60, parallel vertical sides 62, 64 and a curved end 66, the curvature of the end 64 corresponding to that of the tube 20 so as to bear or seat against the inside of the tube 20 in performing a sealing or closing action.

Connected to the valve member 56 is a valve stem or rod 68, the valve stem 68 having a threaded end 70 which is received in the valve member 56, and a second threaded end 72 which is threadedly received in an armature 74 of an electromagnet or solenoid 76, the solenoid 76 being part of the previously alluded to solenoid valve assembly 54. Although the solenoid 76 is of conventional construction, nonetheless it will be no harm to point out that it includes a dielectric spool-like support 78 having a winding disposed thereon. A cylindrical housing 82 contains the spool 78 and winding 80 therein.

Figure 4:
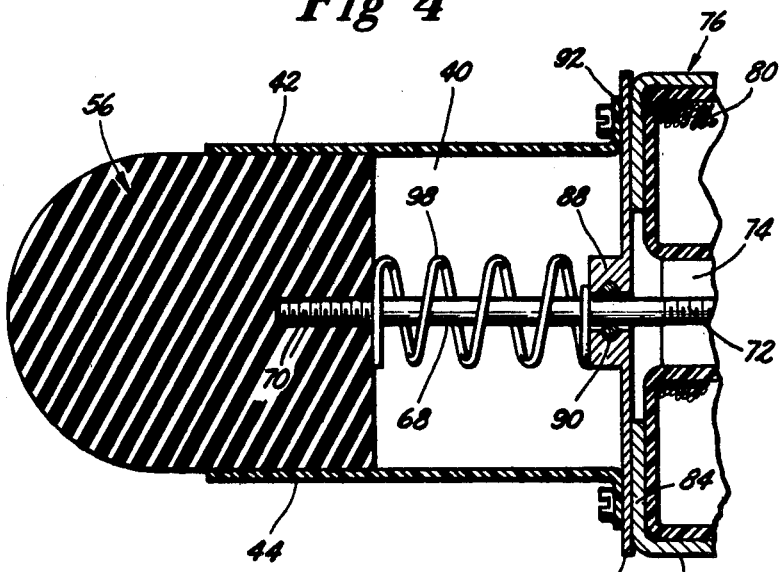
FIG. 4 is a sectional view taken in the direction of line 4—4 of FIG. 2.
Figure 2:
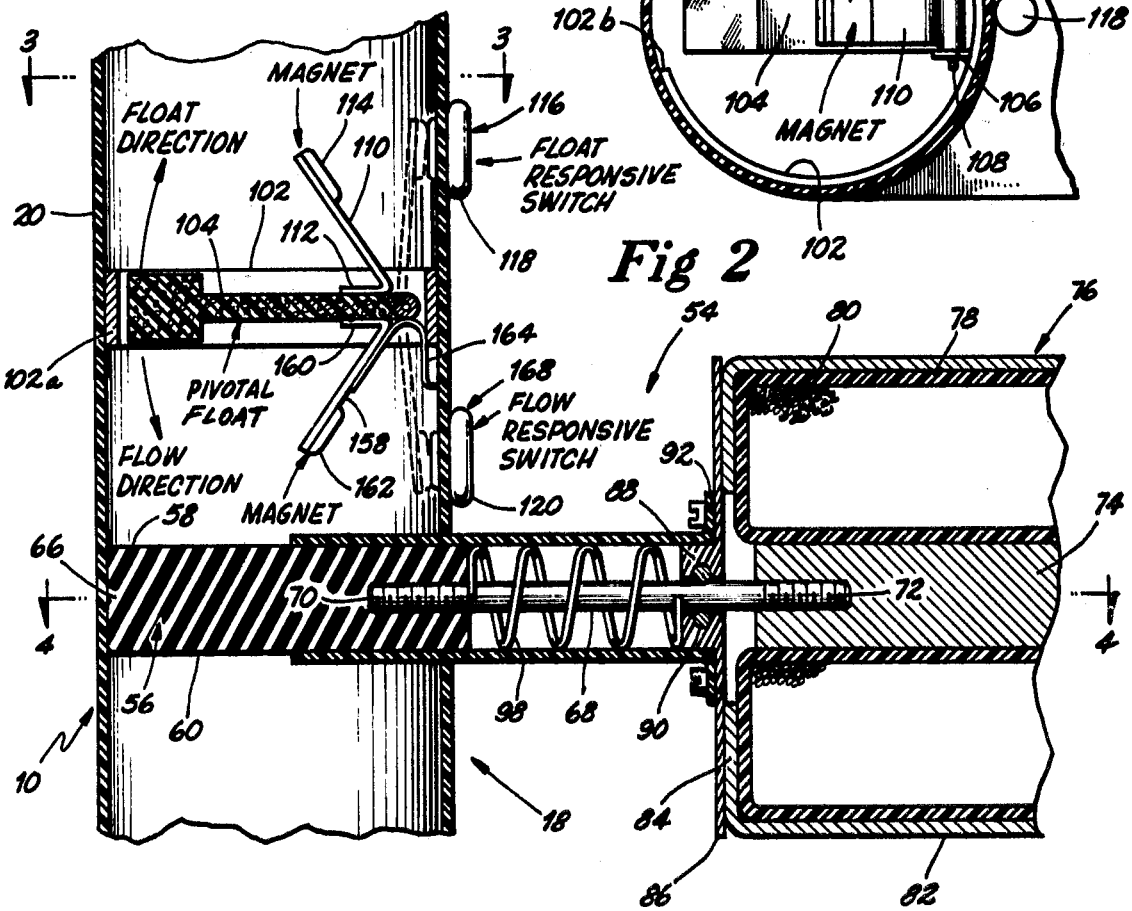
FIG. 2 is an enlarged fragmentary sectional view depicting details not visible in FIG. 1.

As can be appreciated from FIGS. 2, 4 and 5, the solenoid housing 82 is fastened or attached to the valve casing 36. To accomplish this, the solenoid housing 82 is formed with an end wall 84. A removable end plate 86 has a centrally disposed hub 88 containing a rubber O-ring 90 for the sliding and sealing accommodation of the valve stem 68, the plate 86 being sandwiched between the end wall 84 and a flange 92 on the valve casing 36. As best seen in FIG. 5, a plurality of screws 94 fasten the removable end plate to the end wall 86, and an additional plurality of screws 96 fasten the removable end plate 86 to the flange 92.

Inasmuch as the elastomeric valve member 56 is intended to normally be in a closed position, a coil spring 98 encircles the valve or rod 68, one end bearing against the hub 88 on the end wall 86 and the other end against the valve member 56, the spring 98 being under compression so as to urge the valve member 56 to the left as viewed in FIGS. 2 and 5, thereby closing the plastic tube 20. It will be recalled that the valve member 56 is formed with a curved end 66. From FIG. 4, it should be obvious that the curved end 66 conforms to the inner curvature of the tube 20, whereas the vertical sides 62, 64 fit within the valve casing 36, more specifically between the side walls 42, 44 thereof.

As already pointed out, the spring 98 normally biases the valve member 56 into a closed or blocking relationship so that water from the sink 12 cannot drain downwardly into the line 16. It is only when the solenoid 76 is energized that the valve member 56 is retracted so as to open or connect the drain line 16 to the sink 12 via the tailpiece 14 and the intermediate plastic tube 20.

Figure 6:
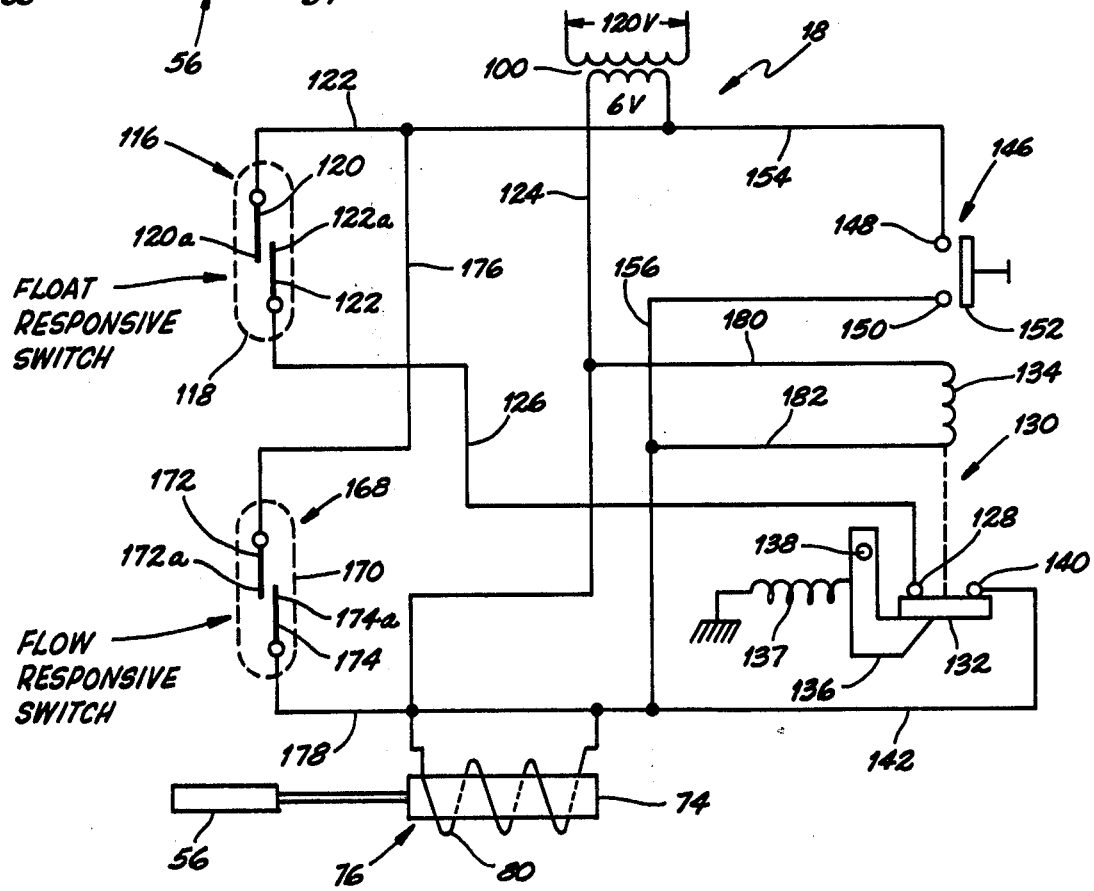
FIG. 6 is an electrical diagram exemplifying a circuit employed when practicing my invention.

Whereas the details of the schematic diagram set forth in FIG. 6 will not be completely comprehensible at this stage, it can be pointed out that the control apparatus 18 makes use of a power source 100, being shown in the form of a step-down transformer, although it could be a d-c source such as a battery. Whereas the primary of the transformer can be connected to a 120 volt a-c outlet, the secondary of the transformer provides a low voltage on the order of six volts for energizing the solenoid 76 and other components still to be referred to.

Although the components now to be described can be mounted within the plastic tube 20 in various ways, the particular mounting means will depend largely on the material of the tube 20. It has already been explained that the tube 20 can be plastic and when a plastic tube is utilized, then the arrangement now to be described can be effectively employed.

Figure 3:
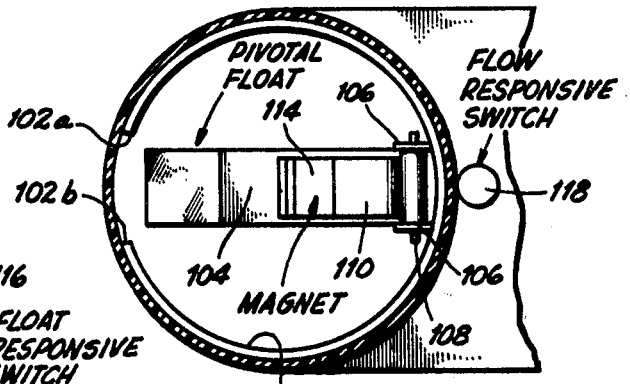
FIG. 3 is a sectional view taken in the direction of line 3—3 of FIG. 2.

From FIGS. 2 and 3 it will be discerned that a resilient split ring 102, which can also be of plastic, has been shown which can be positioned at virtually any height within the plastic tube 20, the circumferentially spaced ends **102*a*, 102*b* simply being pressed closer together so as to permit the ring 102 to be inserted into the plastic tube 20 via its upper end. When the ring 102, which is resilient as pointed out above, is permitted to expand, it pressurally bears against the inside of the tube 20 and will in this way be held in place. However, an adhesive can be employed to retain the ring 102 at the desired location within the tube 20**, if desired.

The apparatus 18 is constructed so as to be both float responsive and flow responsive. In this regard, a vane 104 of buoyant material, such as foamed polyurethane is employed. The vane 104 is pivotally attached at one end to a pair of hinges 106 projecting inwardly from the ring 102, a pin 108 extending through the hinges 106 and the end of the vane 104 adjacent thereto.

An arm 110, which can be of thin metal or a strip of plastic, has a base portion 112 which is adhesively secured to the vane 104, the arm 110 angling upwardly from the hinged end of the vane 104, as can be seen in FIG. 2. The free end of the arm 110 carries a small permanent magnet 114, which is adhesively secured to this portion of the arm 110.

When there is a sufficient accumulation of water, such as from a leaky faucet dripping into the sink 12, the vane 104 will be buoyed upwardly so that the magnet 114 will be moved into a closer relationship with the side of the plastic tube 20, as denoted in phantom outline in FIG. 2.

By means of a holder (not shown), which can be a strip of adhesive tape encircling the outside of the plastic tube 20, a magnetically responsive reed switch 116 is retained in an appropriate portion so that when the magnet 114 is brought into a proximal relation therewith the switch 116 is closed. Although conventional, it can be pointed out that the switch includes a tubular glass envelope 118 containing therein two metallic reeds 120 and 122 (see FIG. 6). One end of each reed 120, 122 is hermetically sealed within the ends of the glass envelope. However, their free or innermost ends overlap and form normally open contacts **120*a* and 120*b*. The metallic reed 120 is connected through the agency of a conductor 122 to one side of the secondary winding of the power source 100, whereas another conductor 124 connects the other side of the power source 100 to the winding 80 of the solenoid 76**.

An additional conductor 126 connects the metallic reed 122 to one fixed contact 128 of a latching relay denoted generally by the reference numeral 130. The latching relay 130 also includes a movable blade or contact 132 which is actuated upwardly when the relay's winding 134 is energized and held by a pivotal dog or latch element 136 which is biased such as by a small coil spring 137, in a counterclockwise direction about a pivot pin 138 but which can be manually rotated in a clockwise direction about its pivot pin 138 for a reason hereinafter made manifest. A second fixed contact 140 is connected via a conductor 142 to the solenoid winding 80.

In this way, when the contacts 120*a*, 120*b* carried on the metallic reeds 120, 122 are closed, which they are when the buoyant vane 102 is pivoted upwardly by the buoyant action of water collected above the valve member 56, then the closing of the contacts 122*a*, 122*b* establishes an electrical path from the power source 100 through the now closed or latched contacts 128, 132 and 140 of the latching relay 130 so as to energize the solenoid 76 and thus retract the valve member 56, thereby providing communication directly from the tailpiece 14 downwardly through the plastic tube 20 to the drain line 16.

As a consequence, any accumulated water, which has collected as a result of a leaky faucet, will automatically be permitted to gravitationally flow downwardly into the drain line 16. As soon as the water that has been collected drains, then the float or buoyant vane 104 will swing downwardly so that the small permanent magnet 114 will be moved away from the magnetically responsive reed switch 116 with the result that the magnetically closed contacts 120*a*, 120*b* will now open so as to deenergize the solenoid 76.

As a result, the coil spring 98, which biases the valve member 56 in a closed direction, will cause the valve member 56 to return once again to the position depicted in FIG. 2 where it again blocks the flow of any liquid downwardly and concomitantly blocks the flow of any sewer gases upwardly that might enter the drain line 16 from the sewer to which the line is connected.

The valve member 56, when closed, functions as a stopper and water can intentionally be held in the sink 12 without using a separate stopper or closure member. However, when the valve member 56 is to be retracted so as to drain deliberately any waste water from the sink 12, a normally open pushbutton switch 146 comprising a pair of fixed contacts 148, 150 and a bridging contact 152 is actuated. The contact 148 is connected to the power source 100 via a conductor 154, whereas the contact 150 is connected to the solenoid 76 through the agency of a conductor 156. In this way, when the normally open pushbutton switch 146 is manually closed, a circuit is completed through the solenoid winding 80 and the energization of the solenoid 76 will retract or open the valve member 56.

Quite obviously, one would not wish to keep the pushbutton switch 146 closed for the entire time that it would take for the contents of the sink 12 to drain. Consequently, my invention provides for maintaining the solenoid 76 energized, and the valve member 56 retracted or opened, during the entire draining period without the person having to keep depressing the pushbutton switch 146.

Accordingly, a flow responsive mechanism is employed. This involves the use of an arm 158 dangling downwardly from a base portion 160, which base portion 160 is adhesively fastened to the underside of the vane 104 in the same fashion the base portion 112 of the arm 110 is attached to the upper side of the same vane 104. The arm 158 at its free end carries a permanent magnet 162 which can be identical to the earlier-mentioned magnet 114.

In this case, however, the flow responsive mechanism includes a bowed leaf spring 164 having one leg portion thereof adhesively attached to the arm 158 so that its other leg portion bears against the inside of the plastic tube 20. In this way, the vane 104 is biased into a generally horizontal position. On the other hand, when the valve member 56 is retracted by energizing the solenoid 76 via the pushbutton switch 146, the flow of the waste water from the sink 12 downwardly through the tube 20 will deflect the vane 104 downwardly. Since the arm 158 is integrally attached to the underside of the vane, such action causes the magnet 162 to be moved into a closely adjacent position with the inside of the plastic tube 20.

A second magnetically responsive read switch 168 is suitably held in place by a holder (also not shown but which can be just an adhesive tape). Here again, the magnetically responsive reed switch 168 includes a tubular glass envelope 170 containing therein two metallic reeds 172 and 174. As with the previously mentioned reed switch 116, one end of each reed 172 and 174 is hermetically sealed within the ends of the glass envelope 170. However, their free or innermost ends overlap, as do the free or innermost ends of the previously mentioned reed switch 116, and form normally open contacts 172*a* and 174*a*. In this way, when the permanent magnet 162 is swung into juxtaposition with the reed switch 168, as it will do when the downwardly flowing waste water deflects the pivotal vane 104 downwardly, overcoming the biasing action of the leaf spring 164 in the process, the magnet 162 will cause the contacts 172*a*, 174*a* to close.

The reed 172 is connected through the agency of a conductor 176 to one side of the power source 100 and the other reed 174 of this particular switch 168 is connected through the agency of another conductor 178 to the solenoid 76 (and to the contact 150 of the pushbutton switch 146 by way of the conductor 156). Stated somewhat differently, the magnetically responsive reed switch 168 is in parallel with the pushbutton switch 146.

There must be a flow of water downwardly through the plastic tube 20 before the contacts 172*a*, 174*a* of the second reed switch 168 are closed. The flow of water can be readily initiated, it is believed evident, by the momentary closing of the pushbutton switch 146 because this action completes a circuit through the solenoid 76 via the conductors 154, 156 and 124. It is, of course, possible, and even likely, that the closing of the contacts 120*a*, 122*a* of the first-mentioned reed switch 116 will cause a flow of water which will close the contacts 172*a*, 174*a* of the second-mentioned reed switch 168, but this has no practical effect because under these circumstances the pushbutton switch 146 would not be closed because, as indicated above, the pushbutton switch 146 is only closed to drain the sink 12. The point to be kept in mind, though, is that as soon as the water has drained out, referring now to the water that has collected due to a leaky faucet, and the flow has ceased, then both the float responsive switch 116 opens (and since there is no longer any flow of water, then the flow responsive switch 168 opens as well), this action resulting in the deenergization of the solenoid 76 and the reclosing of the valve member 56 under the influence of the coil spring 98.

Another event that transpires when the pushbutton switch 146 is closed and the second reed switch 168 is closed (as a result of the flowing water) is that the winding 134 of the latching relay 130 becomes energized which lifts the bridging contact 132 to a height such that the latch or dog 136 can swing beneath the contact 132 to hold it in a raised position and thus close the two contacts 128, 140 which must be closed in order for the first or float responsive switch 116 to be effective in energizing the solenoid 76. The winding 134, it will be appreciated, is connected to the conductors 124 and 156 by means of conductors 180 and 182, respectively.

The dog or latch 136 can be manually swung in a clockwise direction to permit the opening of the contacts 128, 140 of the latching relay 130 in preparation for the closing of the pushbutton switch 146. The contacts 128, 140 will be reclosed after the latching relay 130 has been energized again, this taking place whenever the solenoid 76 is energized because the winding 134 is in parallel with the solenoid winding 80. More specifically, the latching action occurs as a result of the closing of the contacts 172*a*, 174*a* of the flow responsive switch 168 by having first closed the pushbutton switch 146. The second reed switch 168 is closed, of course, by reason of the flow of water downwardly through the plastic tube 20.

In this way, the float responsive reed switch 116 is always in readiness to close should water collect to a sufficient level in the plastic tube 20. It has already been mentioned that such a collection of water can occur due to a leaky faucet. Of course, when the float responsive switch 116 is closed, it remains closed only as long as the water is at a sufficient height to pivot the vane 104 upwardly. When the float responsive switch 116 is closed, however, then the solenoid 76 becomes energized with the consequence that the valve member 56 is opened to drain out the accumulated water. It is important to keep in mind that the valve member 56 remains open only for the length of time needed to drain out the collected water. In other words, the presence of the float responsive switch 116 assures that water will never back up into the sink 12 and overflow the rim thereof, yet there is always a positive seal against any reverse flow of sewer gases upwardly through the drain pipe 16, the plastic tube 20, the tailpiece 14 into the sink 12 (basin, tub or toilet bowl, as the case may be) from which the fumes would then emanate directly into the room.

When practicing the teachings of my invention, it should be readily apparent that each time that the pushbutton switch 146 is closed or the float responsive switch 168 becomes closed, there is an automatic release of the water contained in the system and there is a concomitant venting of odors, due to the flowing water and the concomitant reduced pressure, that may have become present in the room where the sink is installed.

I claim:

1. A drain system for sinks and the like having a drain line associated therewith comprising a movable valve member for closing said drain line when in a first position and opening said drain line when in a second position, means normally biasing said valve member into its said first position, a solenoid for overcoming said biasing means to move said valve member to its said second position when said solenoid is energized, means for energizing said solenoid to move said valve member from its said first position to its said second position, said energizing means including a pushbutton switch for manually effecting energization of said solenoid, and flow responsive means including a normally open switch in parallel with said pushbutton switch so that said solenoid remains energized during the period that water is flowing through said drain line.

2. A drain system in accordance with claim 1 in which said flow responsive means includes a vane pivotally mounted so as to be deflected by the water flowing through said drain line to cause said normally open switch to close.

3. A drain system in accordance with claim 2 in which said flow responsive means incudes a member on said vane for actuating said normally open switch into a closed position.

4. A drain system in accordance with claim 2 including a latching relay having normally open contacts in series with said second normally open switch, said latching relay contacts being closed when said relay is in its latched condition.

5. A drain system in accordance with claim 2 including float responsive means, said float responsive means including a second normally open switch in parallel with said pushbutton switch so that said solenoid is energized when the water in said drain line has reached a given level.

6. A drain system in accordance with claim 5 in which said pivotally mounted vane is of buoyant material, and said float responsive means includes a member on said vane for actuating said second normally open switch into a closed position so as to energize said solenoid.

7. A drain system in accordance with claim 6 including a latching relay having contacts in circuit with said second normally open switch, said latching relay being in parallel with said solenoid so as to be energized when said solenoid is energized.

8. A drain system in accordance with claim 7 in which said latching relay includes a pivotal dog element for maintaining said relay in a latched condition and its contacts closed, said dog element being manually movable so as to open and unlatch the contacts of said latching relay, thereby interrupting the circuit through said second normally open switch and rendering said second switch ineffectual.

9. A drain system in accordance with claim 1 including float responsive means for also energizing said solenoid.

10. A drain system in accordance with claim 9 in which said float responsive means includes a normally open switch responsive to the level of water in said drain line.

11. A drain system for sinks and the like comprising a tubular member extending vertically downwardly having a cutout in one side thereof, a valve casing having a rectangular cross section, said valve casing being configured at one end so as to fit said cutout, said valve casing being secured to said tubular member so as to extend laterally therefrom, an elastomeric valve member reciprocally disposed in said valve casing, said valve member projecting into said tubular member and having a curved end so as to engage the curved side of said tubular member opposite said cutout, spring means for normally urging said valve member in a direction to cause said curved end to engage the curved side of said tubular member opposite said cutout, a solenoid for overcoming the bias of said spring means, and a pushbutton switch for energizing said solenoid so as to retract said valve member into said casing and said curved end away from said curved side, thereby opening said tubular member for the passage of waste water downwardly therethrough.

12. A drain system in accordance with claim 11 including means responsive to the downward passage of waste water from said sink through said tubular member for maintaining said solenoid energized.

13. A drain system in accordance with claim 12 including means for maintaining said solenoid energized which includes a normally open switch in parallel with said pushbutton switch, and means within said tubular member responsive to the passage of waste water downwardly through said tubular member.

14. A drain system in accordance with claim 13 including a second normally open switch responsive to the level of waste water in said tubular member, said second-mentioned switch when closed also causing said solenoid to become energized to retract said valve member and thus open the tubular member for the downward passage of waste water from said sink.

15. A drain system in accordance with claim 14 in which said means within said tubular member includes a vane of buoyant material which actuates said first normally open switch into a closed position due to the passage of waste water through said tubular member, said buoyant vane also actuating said second normally open switch into a closed position when a sufficient amount of liquid has accumulated in said tubular member.

16. A drain system in accordance with claim 15 including a latching relay having contacts in circuit with said second normally open switch, said latching relay providing an electrical path through said solenoid when its contacts are latched closed and said second switch is closed.

17. A drain system in accordance with claim 16 including a dog element for manual unlatching and opening the contacts of said latching relay to open the circuit containing said second normally open switch therein in preparation for the manual actuation of said pushbutton switch.

* * * * *